US008628213B2

(12) United States Patent
Wang et al.

(10) Patent No.: US 8,628,213 B2
(45) Date of Patent: Jan. 14, 2014

(54) INDOOR ILLUMINATOR FOR ADJUSTING LIGHTING FIELD

(75) Inventors: Hsiang-Chen Wang, Chiayi County (TW); Jung-Ming Yeh, Chiayi County (TW)

(73) Assignee: National Chung Cheng University, Chiayi County (TW)

( * ) Notice: Subject to any disclaimer, the term of this patent is extended or adjusted under 35 U.S.C. 154(b) by 207 days.

(21) Appl. No.: 13/332,423

(22) Filed: Dec. 21, 2011

(65) Prior Publication Data

US 2013/0163238 A1 Jun. 27, 2013

(51) Int. Cl.
*F21S 4/00* (2006.01)

(52) U.S. Cl.
USPC ..... 362/225; 362/238; 362/239; 362/249.03; 362/249.07; 362/285

(58) Field of Classification Search
USPC ..... 362/238, 239, 249.03, 249.07, 269, 362/285, 427
See application file for complete search history.

(56) References Cited

U.S. PATENT DOCUMENTS 8,104,920 B2 * 1/2012 Dubord ..... 362/217.12

* cited by examiner

*Primary Examiner* — Stephen F Husar
*Assistant Examiner* — James Cranson, Jr.
(74) *Attorney, Agent, or Firm* — Rosenberg, Klein & Lee

(57) ABSTRACT

An indoor illuminator for adjusting lighting field includes a casing, two adjusting portions and two illuminating strips. The casing has a top plate and two side plates. Each adjusting portion includes a bottom plate and a base plate. The base plate is mounted on the bottom plate. The two illuminating strips are respectively and correspondingly disposed on the two adjusting portions. Each illuminating strip includes an elongated loading plate and an elongated positioning plate. The loading plate has multiple light emitting diodes mounted on the loading plate. The positioning plate is respectively connected with the loading plate and the base plate of a corresponding adjusting portion to be enclosed as a triangular tube. The loading plate is pivotable relative to the base plate such that a projecting angle of the loading plate is adjustable and the lighting field is adjustable.

19 Claims, 10 Drawing Sheets

INDOOR ILLUMINATOR FOR ADJUSTING LIGHTING FIELD

BACKGROUND OF THE INVENTION

1. Field of the Invention

The present invention relates to a lighting device, and more particularly to an indoor illuminator for adjusting lighting field.

2. Description of Related Art

A conventional indoor lighting device integrates multiple light emitting diodes into a single illuminating unit and multiple illuminating units are arranged in an indoor space. The indoor space is equally divided into multiple identical sections. The illuminator units are distributed among the identical sections as a matrix arrangement to provide demanded illuminations.

However, the construction of the office building or the manufactory is complex and the indoor space in the office building or the manufactory is divided into multiple compartments. Therefore, the matrix arrangement of the illuminator units cannot work on the office building or the manufactory. With reference to FIG. 16, multiple conventional illuminating units 90 are arranged in a space. Each conventional illuminating unit 90 provides a quantitative lighting field and a quantitative luminous flux. When each conventional illuminating unit 90 provides a smaller projecting angle and a projected area of the conventional illuminating unit 90 is decreased, the quantitative luminous flux in each basic unit of the projected area is increased, such that the organs of human visual perceptions will be easily injured. When each conventional illuminating unit 90 provides a larger projecting angle and the projected area of the conventional illuminating unit 90 is increased, multiple dark ripples are formed in the space and each dark ripple is located between adjacent two projected areas, such that the organs of human visual perceptions will feel uncomfortable. If more conventional illuminating units are used to solve the dark ripples, the redundant illumination will be projected on the walls and be wasted.

To overcome the shortcomings, the present invention tends to provide an indoor illuminator for adjusting lighting field to mitigate or obviate the aforementioned problems.

SUMMARY OF THE INVENTION

The main objective of the invention is to provide an indoor illuminator for adjusting lighting field that includes a casing, at least two adjusting portions and at least two illuminating strips. The casing has a top plate and at least two side plates. The top plate is provided for reflecting function. The at least two side plates respectively extend from a periphery of the top plate. The at least two adjusting portions are respectively and correspondingly disposed on the at least two side plates. Each adjusting portion includes a bottom plate and a base plate. The bottom plate is connected with a corresponding side plate. The base plate is mounted on the bottom plate. The at least two illuminating strips are respectively and correspondingly disposed on the at least two adjusting portions. Each illuminating strip includes an elongated loading plate and an elongated positioning plate. The loading plate has multiple light emitting diodes mounted on the loading plate. The positioning plate is respectively connected with the loading plate and the base plate of a corresponding adjusting portion along two elongated sides of the positioning plate to be enclosed as a triangular tube. The base plate of each adjusting portion is elongated and has multiple protrusions protruding from the base plate and aligned along a width of the base plate for selectively abutting against the positioning plate of a corresponding illuminating strip for adjusting an angle of the loading plate relative to the base plate. The bottom plate of each adjusting portion is bendable relative to the corresponding side plate, which is connected with the bottom plate.

Other objects, advantages and novel features of the invention will become more apparent from the following detailed description when taken in conjunction with the accompanying drawings.

DETAILED DESCRIPTION OF PREFERRED EMBODIMENT

Figures 1, 2:
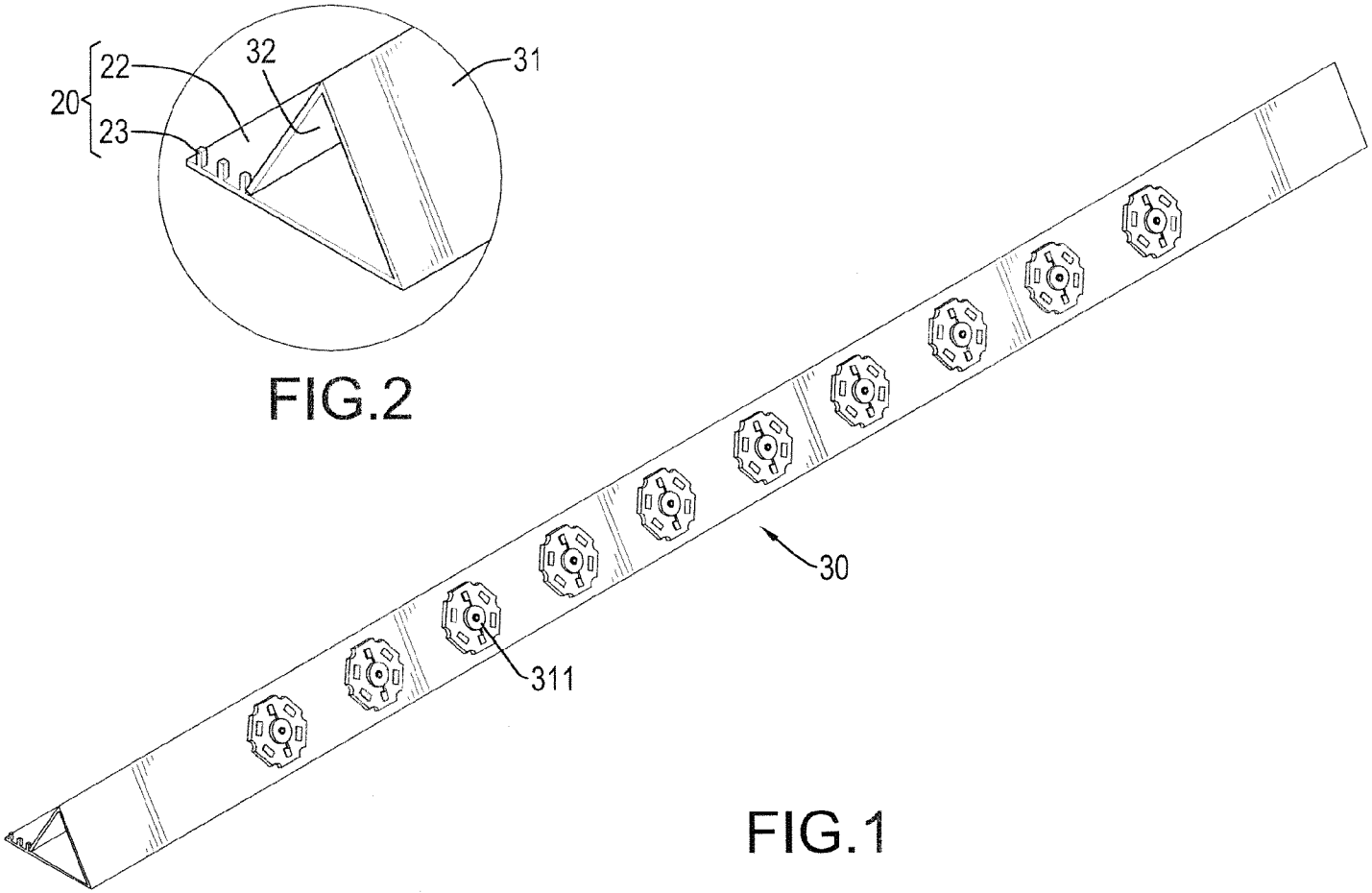
FIG. 1 is a perspective view of an illuminating strip of an indoor illuminator for adjusting lighting field in accordance with the present invention.
FIG. 2 is an enlarged perspective view of the illuminating strip in FIG. 1.
Figure 3:
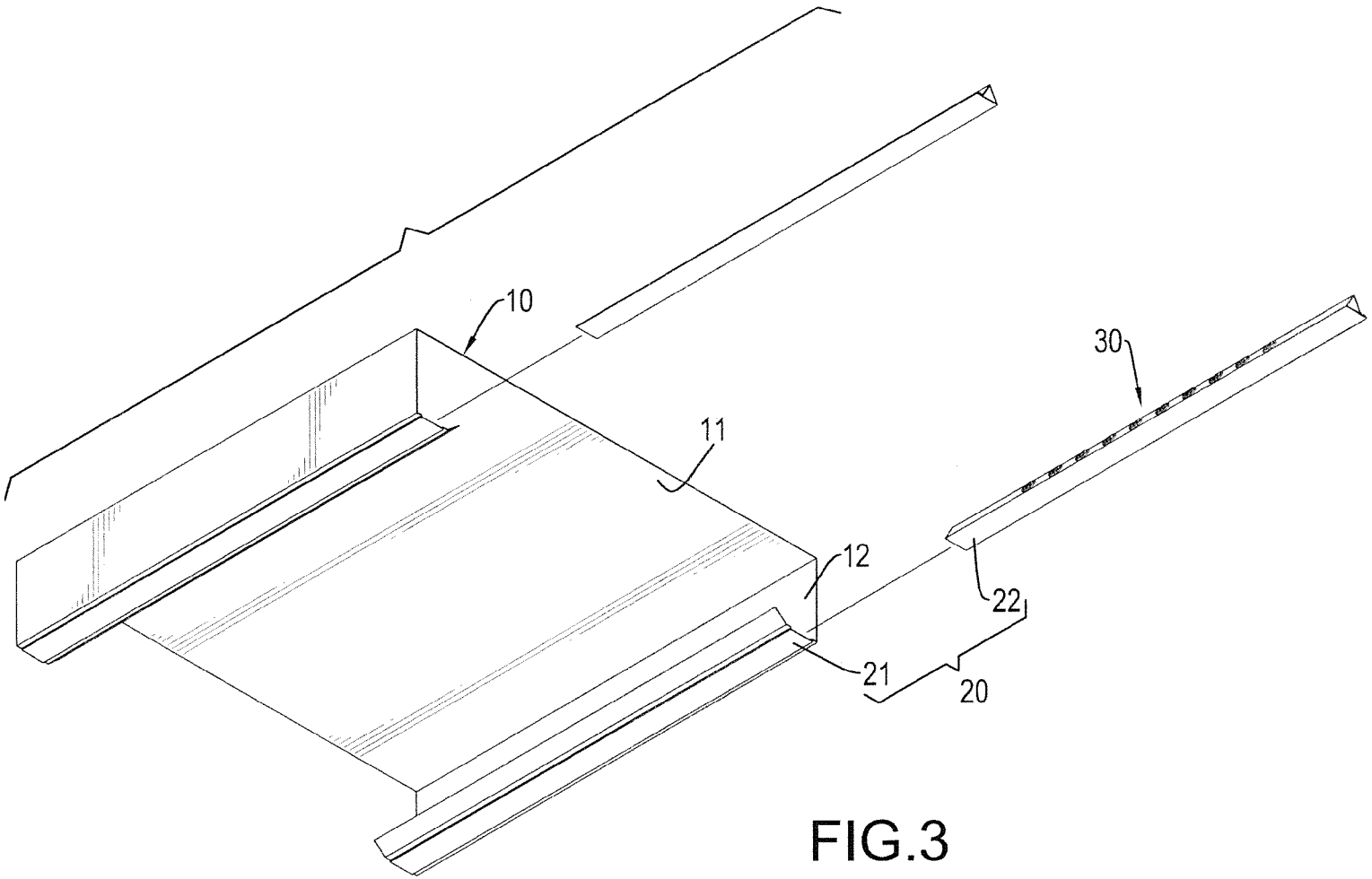
FIG. 3 is an exploded perspective view of the indoor illuminator in accordance with the present invention.

With reference to FIGS. 1 to 4, an indoor illuminator for adjusting lighting field in accordance with the present invention comprises a casing 10, two adjusting portions 20 and two illuminating strips 30.

The casing 10 is stamped from a metal sheet and includes a rectangular top plate 11 and two side plates 12. The top plate 11 is formed of a reflective material, such as metal or glass mirror, for reflecting the light beams emitted from the illuminating strips 30. The two side plates 12 are respectively formed on two opposite ends of a periphery of the top plate 11 and extend downward. A space is defined between the two side plates 12. The light beams reflected from the top plate 11 pass through the space.

Figure 5:
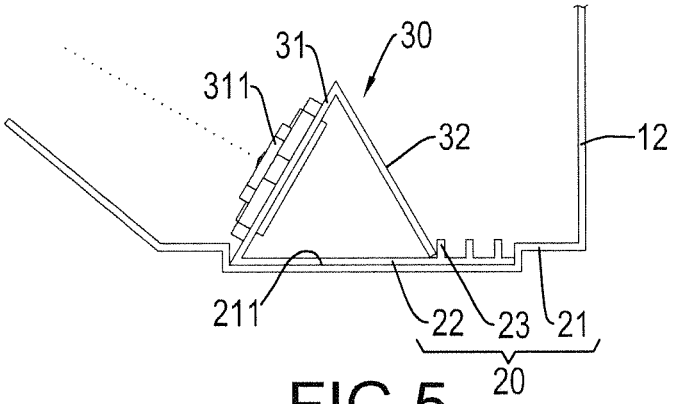
FIGS. 5 to 7 are operational side views of an adjusting portion of the indoor illuminator in FIG. 3.

With further reference to FIG. 5, the two adjusting portions 20 are respectively disposed on the two side plates 12. Each adjusting portion 20 includes a bottom plate 21 and a base plate 22. The bottom plate 21 of each adjusting portion 20 extends inwardly from a corresponding side plate 12. Each bottom plate 21 has a recess 211 defined in the top surface of the bottom plate 21. The base plate 22 of each adjusting portion 20 is mounted in the recess 211 in the bottom plate 21.

The two illuminating strips 30 are respectively disposed on the two adjusting portions 20. Each illuminating strip 30 includes an elongated loading plate 31 and an elongated positioning plate 32. The loading plate 31 of each illuminating strip 30 has multiple light emitting diodes 311 mounted on the loading plate 31. Preferably, each light emitting diode 311 has a wavelength between 380 and 780 nanometers. The light emitting diodes 311 of each loading plate 31 are equally arranged along a length of the loading plate 31 for providing a uniform quantitative luminous flux. The positioning plate 32 of each illuminating strip 30 is respectively connected with the loading plate 31 and the base plate 22 of a corresponding adjusting portion 20 along two elongated sides of the positioning plate 32 to form a triangular tube by the plates 22, 31 and 32. Preferably, the base plate 22 of each adjusting portion 20, the loading plate 31 and the positioning plate 32 of a corresponding illuminating strip 30 are integrally formed and folded from a plane sheet. The base plate 22 of each adjusting portion 20 has a width greater than those of the loading plate 31 and the positioning plate 32 of the corresponding illuminating strip 30.

With reference to FIG. 1, the adjusting portion 20 is provided for adjusting an emitting angle of the light emitting diode 311 of the loading plate 31 of the corresponding illuminating strip 30 relative to the base plate 22. Preferably, the base plate 22 of each adjusting portion 20 is elongated and has three protrusions 23 protruding from the base plate 22 and arranged along a width of the base plate 22 for selectively abutting against the positioning plate 32 of the corresponding illuminating strip 30 and adjusting an angle of the loading plate 31 relative to the base plate 22.

The light emitting diodes 311 of the two illuminating strips 30 are provided for emitting light beams toward the top plate 11 and the top plate 11 reflects the light beams to pass through the space between the two side plates 12.

Figure 6:
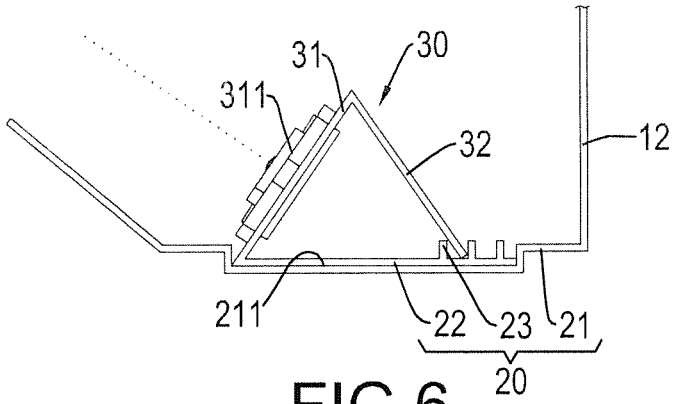
Figure 7:
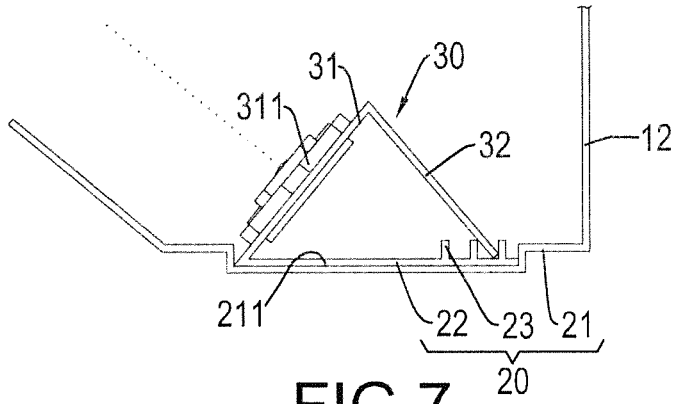

With reference to FIG. 5, when the positioning plate 32 of one of the two illuminating strips 30 abuts against the protrusion 23, as the positioning plate 32 is adjacent to the loading plate 31, the loading plate 31 is pivoted relative to the base plate 22 such that the loading plate 31 has a higher inclination. An angle of the light beams emitted by the light emitting diodes 311 on the loading plate 31 relative to a normal line of the top plate 11 is increased and the projective area of the top plate 11 is also increased and is scattered to generate a greater lighting field. With reference to FIGS. 6 and 7, when the positioning plate 32 abuts against the protrusion 23, which is away from the loading plate 31, the loading plate 31 is pivoted relative to the base plate 22 such that the loading plate 31 has a lower inclination. The angle of the light beams emitted by the light emitting diodes 311 on the loading plate 31 relative to the normal line of the top plate 11 is decreased and the projective area of the top plate 11 is also decreased and is concentrated to generate a smaller lighting field.

Figure 8:
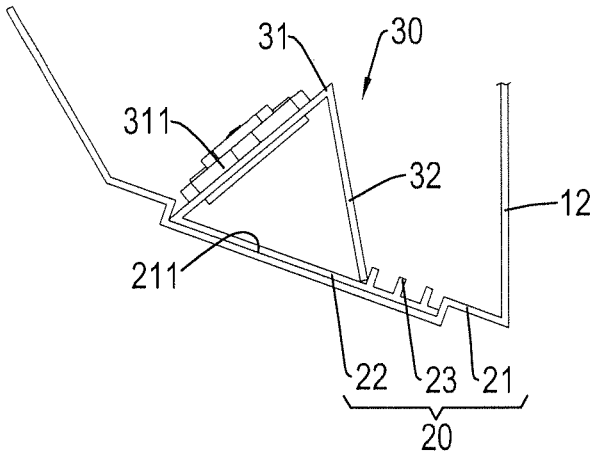
FIGS. 8 and 9 are operational side views of the adjusting portion in FIG. 3.
Figure 9:
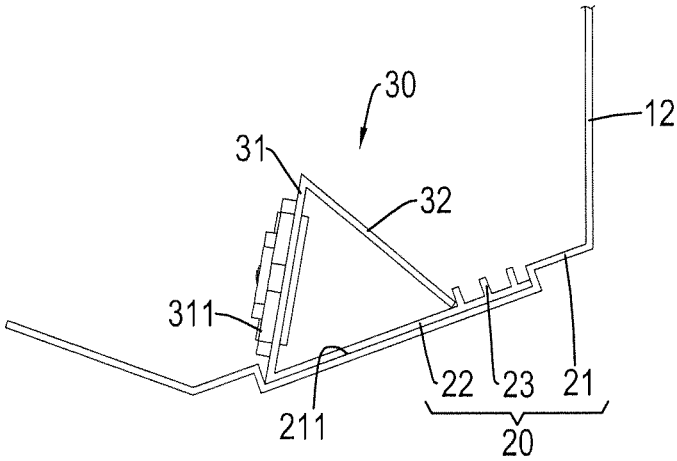

With reference to FIGS. 8 and 9, in a second embodiment of the indoor illuminator in accordance with the present invention, the elements and effects of the second embodiment are same with the first embodiment except the bottom plate 21 of each adjusting portion 20 is bendable relative to the side plate 12. When the bottom plate 21 is upwardly bended, the angle of the light beams emitted by the light emitting diodes 311 on the loading plate 31 of the corresponding illuminating strip 30 relative to the normal line of the top plate 11 is increased and the projective area of the top plate 11 is also increased and is scattered to generate a greater lighting field. When the bottom plate 21 is downwardly bended, the angle of the light beams emitted by the light emitting diodes 311 on the loading plate 31 relative to the normal line of the top plate 11 is decreased and the projective area of the top plate 11 is also decreased and concentrated to generate a smaller lighting field.

Figure 4:
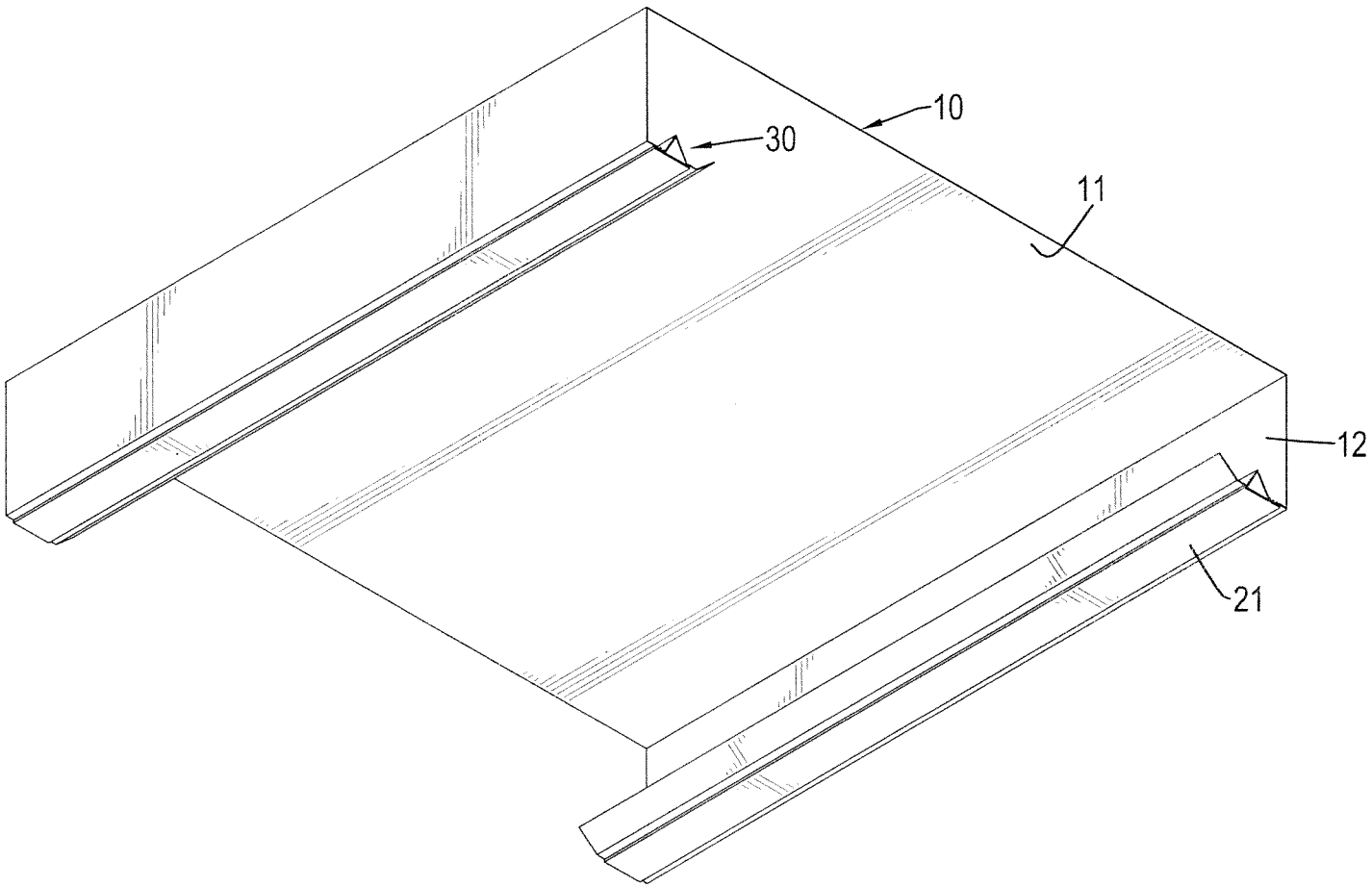
FIG. 4 is a perspective view of the indoor illuminator in FIG. 3.
Figure 10:
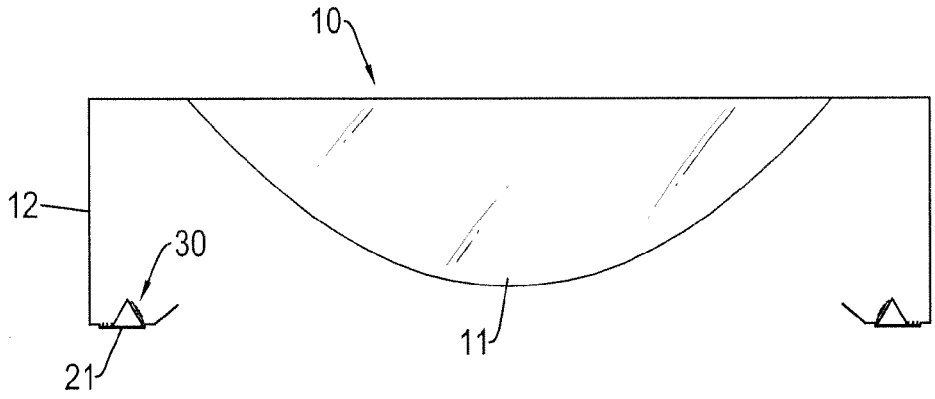
FIGS. 10 to 13 are side views of different types of a top plate of the indoor illuminator in accordance with the present invention.
Figure 11:
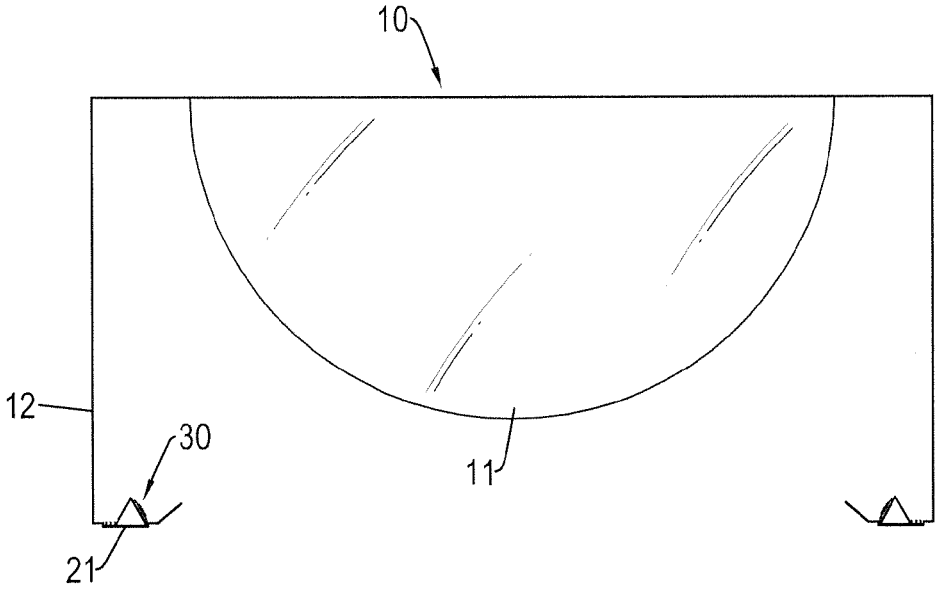
Figure 12:
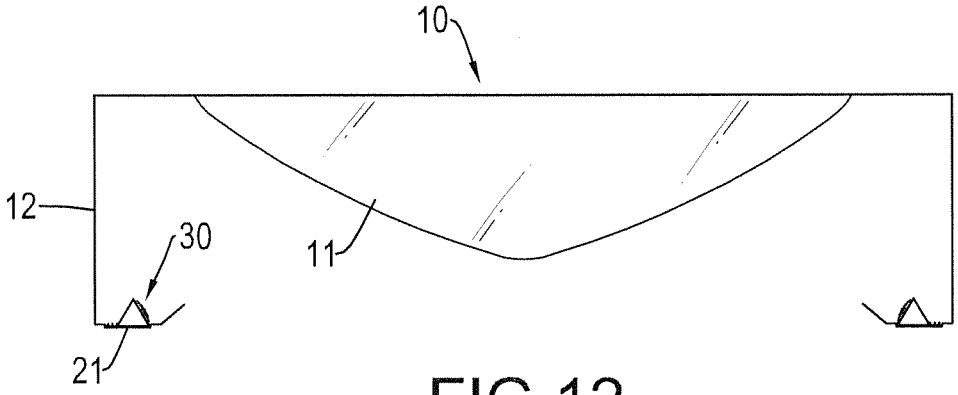
Figure 13:
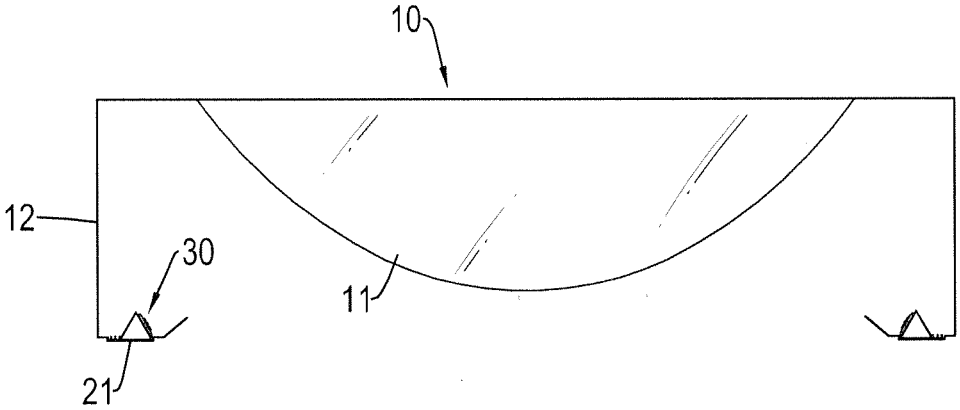
Figure 14:
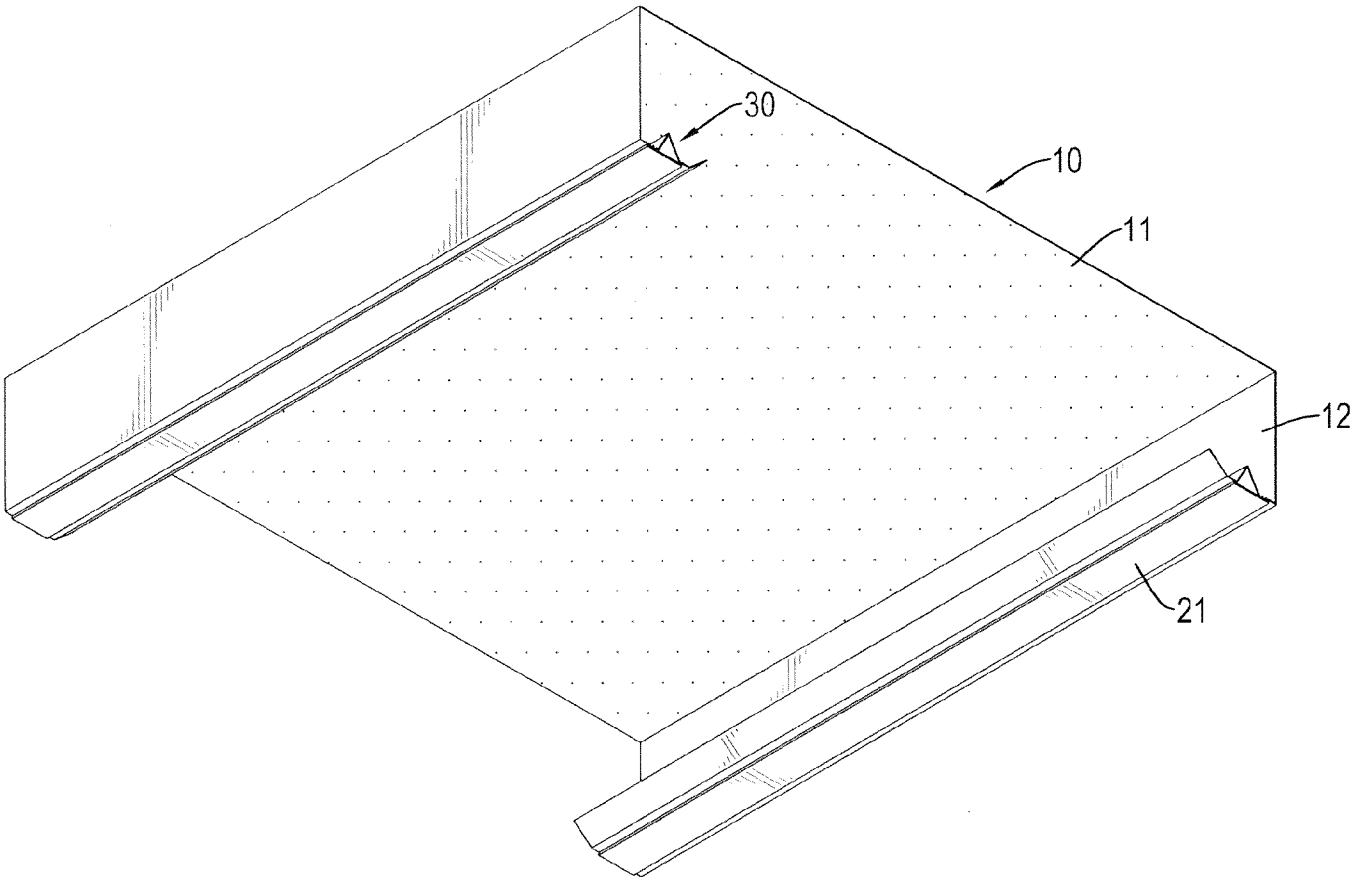
FIG. 14 is a perspective view of a multi-micro-structural mirror type of the top plate of the indoor illuminator in accordance with the present invention.

The shape of the top plate 11 is variable for providing various lighting fields with various results. With reference to FIG. 4, the top plate 11 is a flat mirror. With reference to FIG. 10, the top plate 11 is a parabolic mirror. With reference to FIG. 11, the top plate 11 is a spherical mirror. With reference to FIG. 12, the top plate 11 is a hyperbolic mirror. With reference to FIG. 13, the top plate 11 is an ellipsoidal mirror. With reference to FIG. 14, the top plate 11 is a multi-micro-structural mirror. Therefore, the top plate 11 is chosen from the flat mirror, the parabolic mirror, the spherical mirror, the hyperbolic mirror, the ellipsoidal mirror and the multi-micro-structural mirror.

Figure 15:
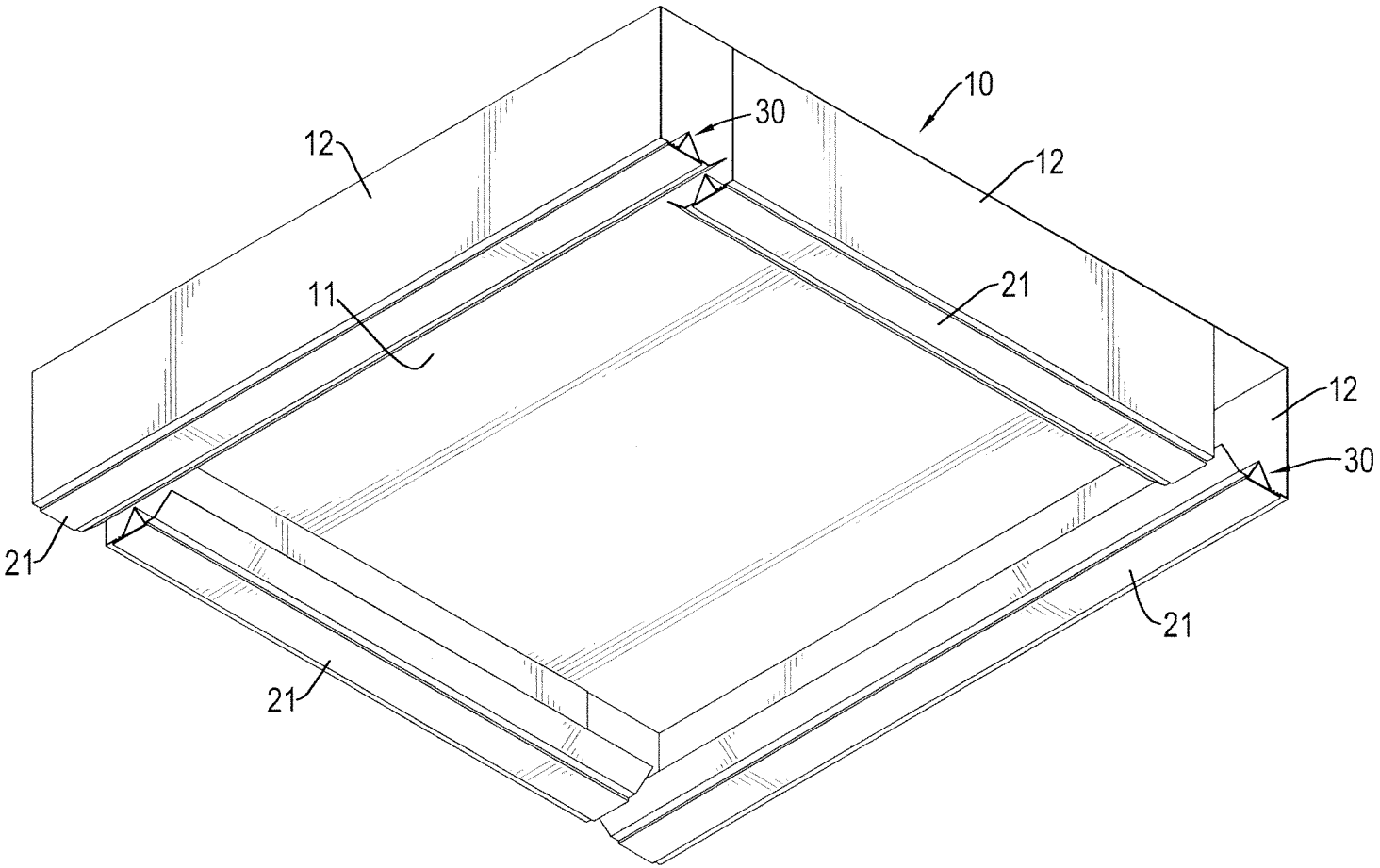
FIG. 15 is a perspective view of a third embodiment of the indoor illuminator in accordance with the present invention.
Figure 16:
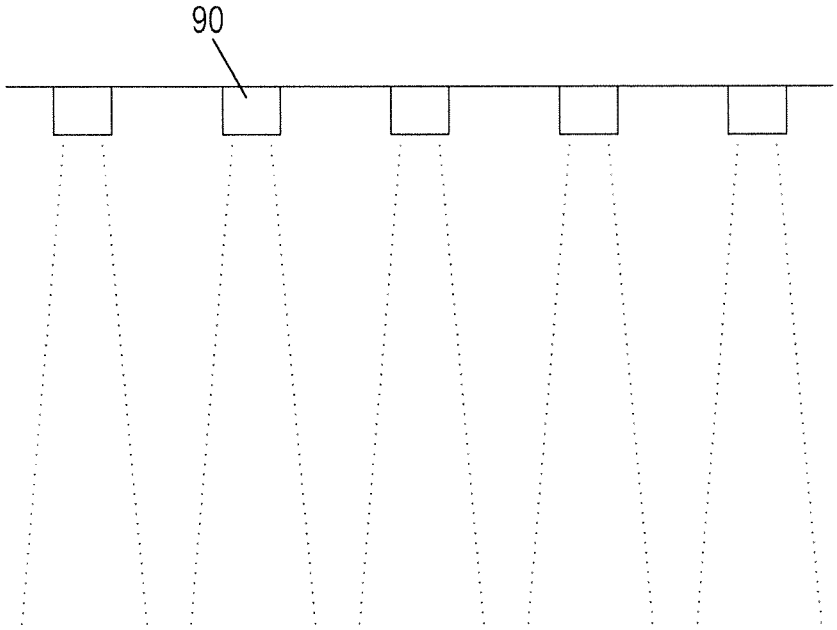
FIG.16 PRIOR ART
FIG. 16 is a side view of an arrangement of multiple illuminating units in accordance with a prior art.

With reference to FIG. 15, in a third embodiment of the indoor illuminator in accordance with the present invention, the elements and effects of the third embodiment are same with the first embodiment except that four side plates 12 respectively extend from the top plate 11. Four adjusting portions 20 are respectively mounted on the four side plates 12. Four illuminating strips 30 are respectively disposed on the four adjusting portions 20.

Each adjusting portion 20 of the present invention is provided for adjusting the emitting angle to change the lighting field. The indoor illuminator in accordance with the present invention can be suitable for a different indoor arrangement and provide a uniform illumination. For example, the light in front of a projector can be decreased or turned off and the light in back of the projector is normal. Therefore, the indoor illuminator in accordance with the present invention is suitable for different environmental requirements. The base plate 22 of each adjusting portion 20, the loading plate 31 and the positioning plate 32 of the corresponding illuminating strip 30 are integrally formed and simply folded from the plane sheet. The light emitting diodes 311 are pre-mounted on the loading plate 31. A glare of the indoor illuminator in accordance with the present invention can be controlled to a reasonable range and avoid causing multi-shadows, such that there is no necessity to mount an additional diffusion sheet on the present invention. The structure of the present invention is simplified. The manufacture of the present invention is easy and the manufacturing cost can be decreased.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An indoor illuminator for adjusting lighting field comprising:

a casing having a top plate provided for reflecting function; and at least two side plates respectively extending from a periphery of the top plate; and at least two adjusting portions respectively and correspondingly disposed on the at least two side plates, each adjusting portion including a bottom plate connected with a corresponding side plate; and a base plate mounted on the bottom plate; and at least two illuminating strips respectively and correspondingly disposed on the at least two adjusting portions, each illuminating strip including an elongated loading plate having multiple light emitting diodes mounted on the loading plate; and an elongated positioning plate respectively connected with the loading plate and the base plate of a corresponding adjusting portion along two elongated sides of the positioning plate to be enclosed as a triangular tube.

2. The indoor illuminator as claimed in claim 1, wherein the base plate of each adjusting portion and the loading plate and the positioning plate of a corresponding illuminating strip are integrally formed and folded from a plane sheet.

3. The indoor illuminator as claimed in claim 2, wherein the base plate of each adjusting portion is elongated and has multiple protrusions protruding from the base plate and aligned along a width of the base plate for selectively abutting against the positioning plate of a corresponding illuminating strip for adjusting an angle of the loading plate relative to the base plate.

4. The indoor illuminator as claimed in claim 3, wherein the bottom plate of each adjusting portion is bendable relative to the corresponding side plate, which is connected with the bottom plate.

5. The indoor illuminator as claimed in claim 4, wherein the bottom plate of each adjusting portion has a recess defined in the bottom plate for receiving a corresponding base plate.

6. The indoor illuminator as claimed in claim 5, wherein the numbers of each of the at least two side plates, the at least two adjusting portions and the at least two illuminating strips are respectively four, the four side plates respectively extend from the top plate, the four adjusting portions are respectively mounted on the four side plates, and the four illuminating strips are respectively arranged on the four adjusting portions.

7. The indoor illuminator as claimed in claim 6, wherein the top plate is chosen from one of a flat mirror, a parabolic mirror, a spherical mirror, a hyperbolic mirror, an ellipsoidal mirror and a multi-micro-structural mirror.

8. The indoor illuminator as claimed in claim 1, wherein the base plate of each adjusting portion is elongated and has multiple protrusions protruding from the base plate and aligned along a width of the base plate for selectively abutting against the positioning plate of a corresponding illuminating strip for adjusting an angle of the loading plate relative to the base plate.

9. The indoor illuminator as claimed in claim 1, wherein the bottom plate of each adjusting portion is bendable relative to the corresponding side plate, which is connected with the bottom plate.

10. The indoor illuminator as claimed in claim 2, wherein the bottom plate of each adjusting portion is bendable relative to the corresponding side plate, which is connected with the bottom plate.

11. The indoor illuminator as claimed in claim 1, wherein the bottom plate of each adjusting portion has a recess defined in the bottom plate for receiving a corresponding base plate.

12. The indoor illuminator as claimed in claim 2, wherein the bottom plate of each adjusting portion has a recess defined in the bottom plate for receiving a corresponding base plate.

13. The indoor illuminator as claimed in claim 3, wherein the bottom plate of each adjusting portion has a recess defined in the bottom plate for receiving a corresponding base plate.

14. The indoor illuminator as claimed in claim 1, wherein the numbers of each of the at least two side plates, the at least two adjusting portions and the at least two illuminating strips are respectively four, the four side plates respectively extend from the top plate, the four adjusting portions are respectively mounted on the four side plates, and the four illuminating strips are respectively arranged on the four adjusting portions.

15. The indoor illuminator as claimed in claim 2, wherein the numbers of each of the at least two side plates, the at least two adjusting portions and the at least two illuminating strips are respectively four, the four side plates respectively extend from the top plate, the four adjusting portions are respectively mounted on the four side plates, and the four illuminating strips are respectively arranged on the four adjusting portions.

16. The indoor illuminator as claimed in claim 3, wherein the numbers of each of the at least two side plates, the at least two adjusting portions and the at least two illuminating strips are respectively four, the four side plates respectively extend from the top plate, the four adjusting portions are respectively mounted on the four side plates, and the four illuminating strips are respectively arranged on the four adjusting portions.

17. The indoor illuminator as claimed in claim 1, wherein the top plate is chosen from one of a flat mirror, a parabolic mirror, a spherical mirror, a hyperbolic mirror, an ellipsoidal mirror and a multi-micro-structural mirror.

18. The indoor illuminator as claimed in claim 2, wherein the top plate is chosen from a flat mirror, a parabolic minor, a spherical mirror, a hyperbolic mirror, an ellipsoidal mirror and a multi-micro-structural mirror.

19. The indoor illuminator as claimed in claim 3, wherein the top plate is chosen from one of a flat mirror, a parabolic mirror, a spherical mirror, a hyperbolic mirror, an ellipsoidal mirror and a multi-micro-structural mirror.

* * * * *